US005775214A

United States Patent [19]

Bielfeldt et al.

[11] Patent Number: 5,775,214

[45] Date of Patent: Jul. 7, 1998

[54] APPARATUS FOR THE CONTINUOUS PRODUCTION OF PARTICLE, FIBER, PLASTIC AND WOOD BOARDS

[75] Inventors: Friedrich B. Bielfeldt, Pähl; Detlef Kroll, Eppingen, both of Germany

[73] Assignee: Maschinenfabrik J. Dieffenbacher GmbH & Co., Eppingen, Germany

[21] Appl. No.: 654,100

[22] Filed: May 28, 1996

[30] Foreign Application Priority Data

May 28, 1995 [DE] Germany ..... 195 18 879.9

[51] Int. Cl.[6] ..... B30B 15/34; B30B 5/06

[52] U.S. Cl. ..... 100/306; 100/154; 156/583.5; 425/371

[58] Field of Search ..... 100/48, 154, 211, 100/237, 269.06, 295, 305, 306, 311, 315, 324, 325; 156/583.5; 425/371

[56] References Cited

U.S. PATENT DOCUMENTS

| | | | |
|---|---|---|---|
| 2,981,307 | 4/1961 | Malarkey, Jr. | 100/154 |
| 3,130,761 | 4/1964 | Fleming et al. | 100/325 |
| 4,943,339 | 7/1990 | Ernest | 100/237 |
| 5,112,209 | 5/1992 | Ahrweiler et al. . | |
| 5,253,571 | 10/1993 | Bielfeldt et al. . | |
| 5,323,696 | 6/1994 | Bielfeldt et al. . | |
| 5,333,541 | 8/1994 | Bielfeldt et al. . | |
| 5,404,810 | 4/1995 | Bielfeldt . | |
| 5,454,304 | 10/1995 | Bielfeldt . | |

FOREIGN PATENT DOCUMENTS

| | | | |
|---|---|---|---|
| 198131 | 6/1958 | Austria | 100/154 |
| 38 25 819 | 2/1990 | Germany . | |

*Primary Examiner*—Stephen F. Gerrity
*Attorney, Agent, or Firm*—Foley & Lardner

[57] ABSTRACT

A continuously operating press produces particle, fiber, plastic and wood boards continuously from pressing stock. The press includes a heating platen provided on one side of the press and a plurality of press platen segments arranged on a side opposite to the heating platen. The press platen segments are resiliently coupled to one another by snap-action hinges and the separation space between the press platen segments and the heating platen is independently adjusted. The pressing stock is pulled through the separation space which has been optimally controlled to produce boards with desired density profiles at a maximum production speed.

15 Claims, 9 Drawing Sheets

9
9b
9a
12
14
15
16
17
R
18
9
25
24
28
32

APPARATUS FOR THE CONTINUOUS PRODUCTION OF PARTICLE, FIBER, PLASTIC AND WOOD BOARDS

BACKGROUND OF THE INVENTION

1. Field of the Invention

The invention relates to a process and an apparatus for the continuous production of particle, fiber, plastic and wood boards.

2. Background of the Invention

It is known from several processes and installations for the continuous production of particle, fiber, plastic and wood boards to vary the compression angle in the entry gap and, with setting devices, the nip clearance between a press ram and a press table, i.e., between upper and lower heating platens, such that, depending on the requirement for the final strength of the board of wood-based material to be produced, the state of the fiber/particle mat can be adapted along the entire pressing length over time as it passes through the required process sequence.

For example, the setting of the different entry angles for thin (2.5 mm) and thick (20 mm) fiber (MDF) boards is described in EP 0,380,527 which corresponds to U.S. Pat. No. 5,112,209. Controlling convex or concave angular positions, a technique which provides far more flexibility in the adjustment of the entry angles, is disclosed in DE 43 01 594 which corresponds to U.S. Pat. No. 5,404,810 and 5,454,304. With both of these known configurations, the physical functional properties, such as the flexural strength and the surface hardness of the face layer, are substantially affected. The transverse tensile strength and, in the case of fiber (MDF) boards, the apparent density profile are determined along the remaining pressing length by the setting of different lip clearances between the upper and lower heated press platens (FIG. 1, Sections b, c and e).

In Section b, the particle fiber mat is subjected to high specific pressing force of about 4–5N/mm$^2$ and high specific heat input at a temperature level of approximately 220° C. to 250° C., and there occurs as a result of this energy density, a concentrated thermal pervasion into the particle fiber mat. The amount of thermal pervasion into the particle fiber mat is a determinant process variable for adequate transverse tensile strength. Depending on the board thickness and board density, the control system sets the length of the required pressing zone b, i.e., the number of force-generating press frames (see FIGS. 1 and 9), in accordance with the assigned pressing (steel belt) speed.

According to the prior art, the low-pressure zone c in the middle region of the pressing zone is controlled in order to establish an apparent density profile shown in FIG. 7. According to FIG. 3, in the low-pressure region of approximately 0N/mm$^2$, the press nip between the upper press/heating platen and the lower press/heating platen is enlarged in comparison with the desired thickness of the fiber board. According to currently established practice, the enlargement, based on the density of the fiber board, which is, for example, between 650 kg/m$^3$ and 850 kg/m$^3$, is by about 20% to 70%, preferably greater than or equal to 50%.

The variation in the nip clearance or the press nip takes place by a spherical deformation of at least the upper and/or the lower press/heating platen in a statically permissible strength range within the elasticity limit. At the technological optimum, along with a sometimes technologically necessary transversal deformation, the longitudinal deformation limit in the case of the known continuously operating press systems is around 2 mm/m, which can also be expressed as tan a of approximately 0.002 ($\alpha$ is shown in FIG. 1).

According to DE 40 17 791, (which corresponds to U.S. Pat. Nos. 5,253,571 , 5,323,696 and 5,333,541) the longitudinal deformation of the upper press/heating platen takes place along the pressing zones b, c and e by means of hydraulic actuators, which act with positive engagement on flexibly designed press ram modules. The disadvantage of such a system is the relatively limited elastic deformability with a tan $\alpha$ of approximately 0.002 (FIG. 1).

In the case of the known systems, the longitudinal deformation is caused by the press/heating platens being positively engaged throughout, and the beginning and end of the low-pressure central zone c, with the "decompression region $d_k$" and the "compression region k," is adjusted according to the board thickness and density on the basis of different pressing (steel belt) speeds on line, i.e., during production to produce variable effective lengths of the high-pressure zone and the gelling (setting) and calibrating zone e. Variations in the effective lengths b1, c1, e1, and $d_{k1}$ and k1, if a greater nip clearance also has to be set, are also shown in FIG. 1.

In the case of cycle-bound multi-daylight presses, it is known for the production of lightweight fiber boards, so-called ultra lightweight boards whose density profile is as shown in FIG. 8, to set the decompression time analogous to dk or $d_{k1}$ to be extremely short by a quick opening of the press/heating platen in a way corresponding to the required nip clearance.

However, with the known continuously operating press systems described earlier, such lightweight boards with average densities of approximately 400 kg/m$^3$ cannot be easily produced. In order to produce the lightweight boards of FIG. 8 with a density equal to or less than 400 kg/m$^3$ with the known continuously operating presses, solutions with greatly restricted economic productivity has been developed.

According to DE 38 25 819, by means of a plastic, but fixedly positioned load-relieving (i.e., decompression) zone $d_k$ and compression zone k, an angle which is far steeper than the previous angle tan $\alpha$ can be obtained. That is to say, the position of $d_k$ and k along the pressing zone L (FIG. 3) allows an optimum production of lightweight boards with regard to density and maximally usable production speed, although only for a previously defined board thickness.

The more flexible heating platen system according to DE 44 05 343 does allow the controlled setting of a steeper angle greater than tan $\alpha$of 0.002, but is not adequate in the degree of deformation to meet the technological requirements for the production of lightweight boards with a step function analogous to tan $\beta$ as shown in FIG. 2.

In terms of process engineering, the known continuously acting press systems have restricted areas of application in comparison with cycle-bound presses, in particular for the production of lightweight boards whose properties are illustrated in FIG. 8. In particular, the economic use of the known continuously acting press systems is greatly limited, because optimum production rates are possible only in a very narrow range, i.e., only for a defined board thickness corresponding to the fixed pressing zone L on the basis of the geometrically fixed and defined position of the sudden load-relieving change zone.

SUMMARY OF THE INVENTION

An object of the invention is to improve the above-described conventional process by providing a method and apparatus for the continuous production of particle, fiber, plastic and wood boards such that it is possible to optimally control and obtain the density profiles shown in FIGS. 7 and 8, which show variations in the average density ranging from more than 900 kg/m$^3$ to less than 400 kg/m$^3$, independent of the particle fiber mat thickness and the type of wood and glue system and with a maximum production speed.

The process according to the invention is adjustable to produce thin boards (approximately 2.5 mm thick), and thick boards (approximately 60 mm thick), in a most optimum way through a snap-action hinge system. The process requires a press length for $d_k$ and k of only 0.4 m. With a customary total press length of about 30 meters, a press length of 32% can be saved, or seen conversely, more pressing length is available. In other words, it is possible to run at production rates which are higher by 25% to 35% by means of a higher steel belt speed. The process according to the invention is further enhanced by the greater heat energy potential which is supplied to the pressing stock on account of the longer pressing force action applied to the pressing stock.

As a result, the process according to the invention offers at least three major advantages over the prior art:

(a) Given the same press length, a production rate which is higher by about 30%.

(b) The production of lightweight boards with an average apparent density of less than or equal to 400 kg/m$^3$ with variable application for thin and thick boards without restricting production speeds.

(c) The controlled setting of the most optimum apparent density profiles with particularly high surface hardnesses and a low homogeneous density structure in the core of the board.

Additional objects and advantages of the invention will be set forth in the description which follows. The objects and advantages of the invention may be realized and obtained by means of the instrumentalities and combinations particularly pointed out in the appended claims.

BRIEF DESCRIPTION OF THE DRAWINGS

The invention is described in detail herein with reference to the drawings in which:

FIG. 3 shows the pressing-pressure/position diagram associated with the continuously operating press according to both FIGS. 1 and 2;

Figures 1, 2:
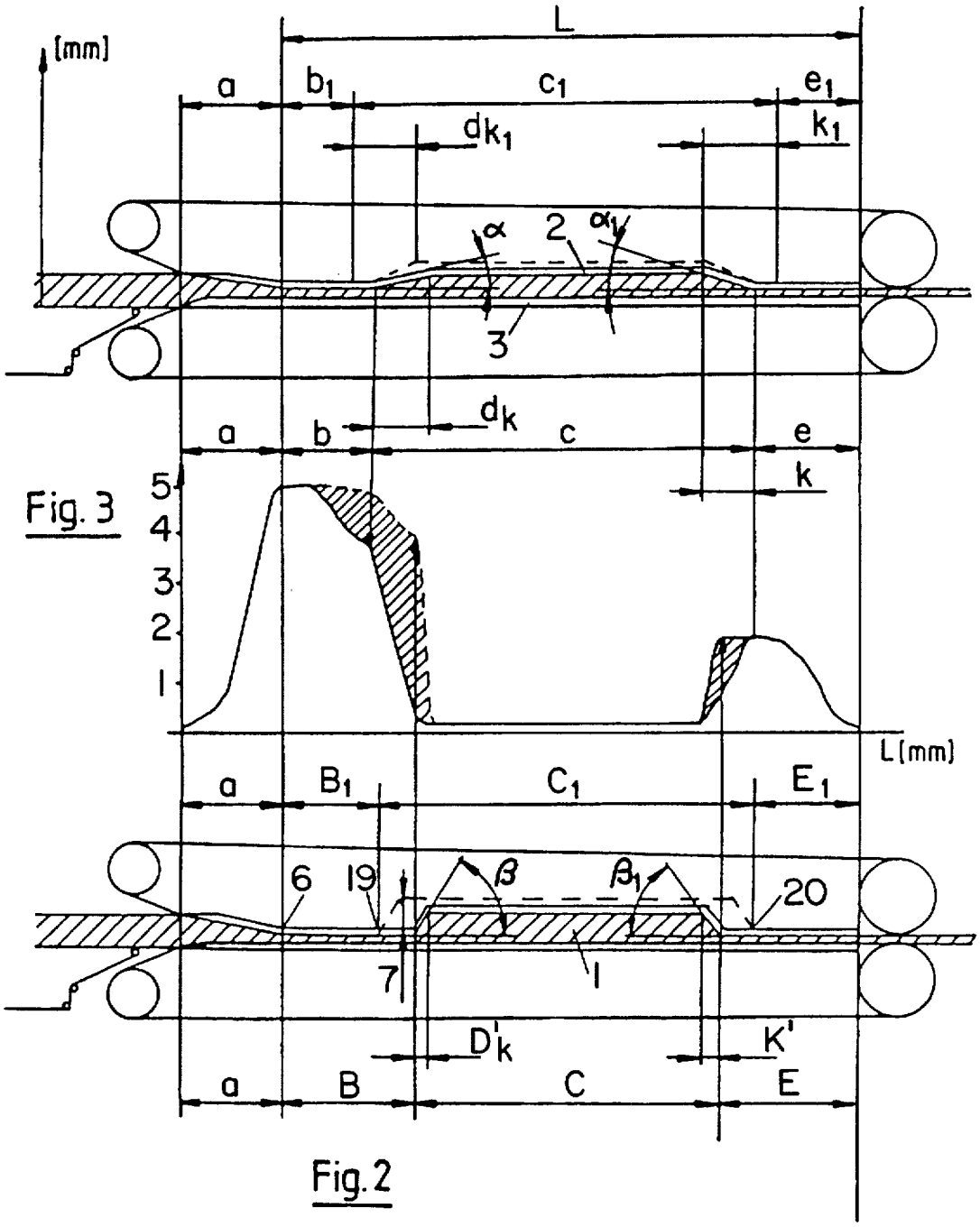
Fig.1 (PRIOR ART)
FIG. 1 shows, in schematic representation and elevation, the existing capability according to the prior art continuously operating press to set the load-relieving zone c with a small angle $\alpha$ and $\alpha_1$.
FIG. 2 shows, in schematic representation and elevation, the capability of the continuously operating press according to the invention to set the load-relieving zone c with a steeper angle $\beta$ and $\beta_1$.

The accompanying drawings, which are incorporated in and constitute a part of the specification, illustrate presently preferred exemplary embodiments of the invention, and, together with the general description given above and the detailed description of the preferred embodiments given below, serve to explain the principles of the invention.

DETAILED DESCRIPTION OF THE PREFERRED EMBODIMENT

A preferred embodiment of the apparatus according to the invention is illustrated in FIGS. 2 and 9 to 11 and includes a continuously operating press 8, a charging device 26 with a transfer lug 27 for pressing stock or particle/fiber mat 28, and a computer 54 controlling the apparatus with a servo hydraulic system 55.

Figure 10:
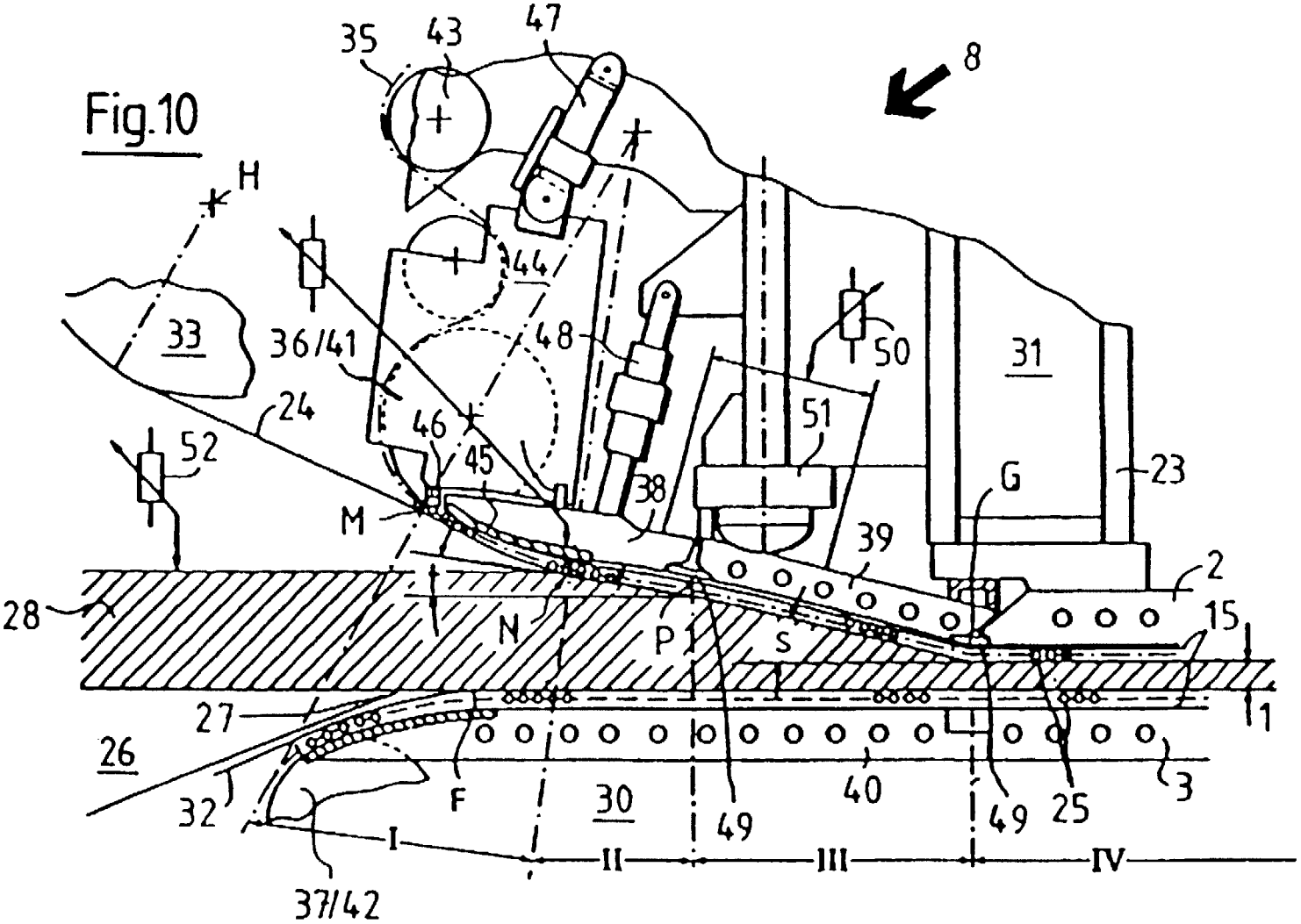
FIGS. 10 and 11 show, in elevation, the front part of the continuously operating press according to FIG. 9 in greater detail.
Figure 11:
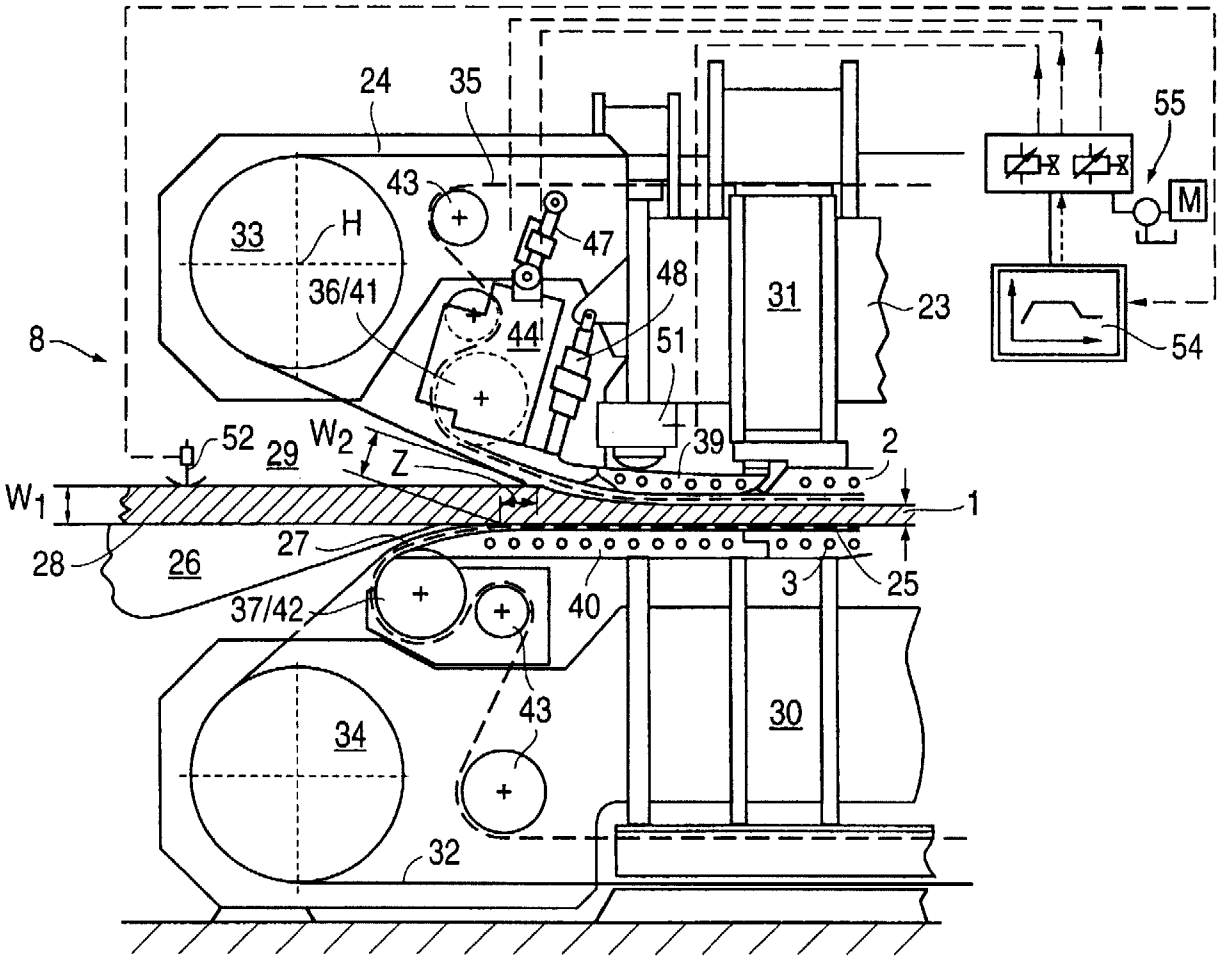

The front part of the continuously operating press 8 is illustrated in FIGS. 10 and 11. The front part includes an input for the particle fiber mat 28, the charging device 26, an entry gap 29, an entry region with a rolling-rod straightening region I, a precompaction stage II, a postcompaction stage III, and the beginning of a main pressing region IV.

The main parts according to FIG. 11 are a press table 30, a movable press ram 31, and tiebars 23 connecting the latter. The press nip 1 is set by moving the press ram 31 up and down by hydraulic piston-cylinder arrangements (not shown) and then stopping the press ram 31 in the chosen position. The steel belts 24 and 32 are guided over driving drums, which are arranged at the other end of the press ram 31 and press table 30, and over reversing drums 33 and 34, respectively.

To reduce friction i.e. to provide a friction reducing surface,between the press/heating platens 2/3, which are fitted on the press table 30 and press ram 31, and between the circulating steel belts 24 and 32, there is provided for each steel belt, a carpet of rolling rods 25. The rolling rods 25, the axes of which extend transversely to the belt running direction and over the entire width of the pressing region, are connected together on both longitudinal sides of the continuously operating press 8 by plate-link chains 35 with a predetermined pitch and are guided through the press 8 between the press/heating platens 2/3 on one side and the steel belts 24 and 32 on the other side, in a rolling manner.

Figure 9:
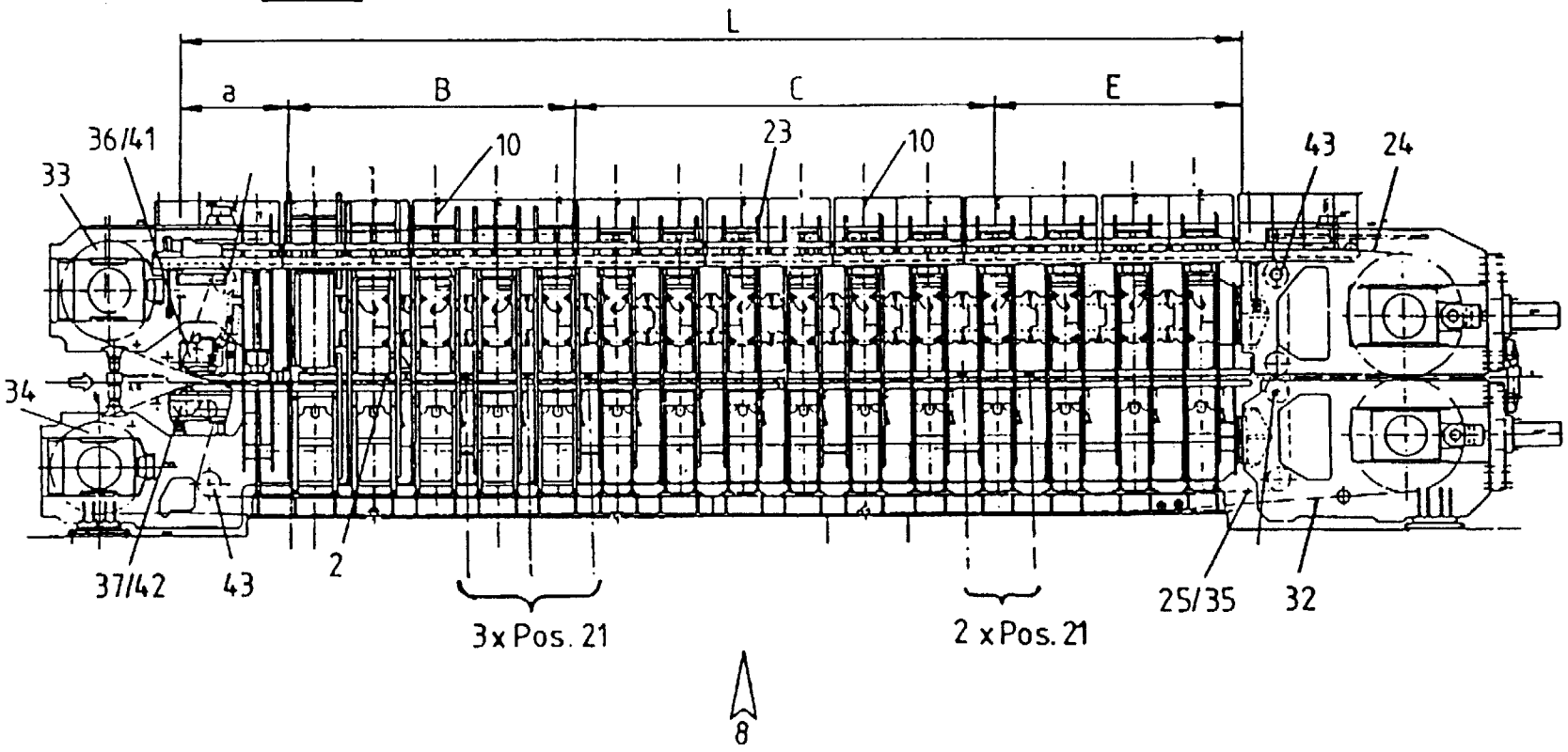
FIG. 9 shows, in elevation, the continuously operating press according to the invention.

As shown in FIGS. 9, 10 and 11, the rolling rods 25 are introduced by introducing gear wheels 36 and 37, and the plate-link chains 35 are introduced by two entry gear wheels 41 and 42, which are arranged to the sides of the supporting beams 38 and 39 and to the sides of the entry heating platen 40, into the horizontal pressing plane in a positively and non-positively engaging manner. The introducing gear wheels 36 are fastened on the press ram 31 and the introducing gear wheels 37 are fastened on the press table 30; and the entry gear wheels 41 are fastened on the press ram 31 and the entry gear wheels 42 are fastened on the press table 30. Gear wheels 36 and 41 are fastened on one spindle, and gear wheels 37 and 42 are fastened on one spindle. "M" indicates the beginning of the entry region (entry tangent) of the rolling rods 25 and "G" indicates the end of the entry region and the beginning of the main pressing region IV. The rolling rod circulation in the press table 30 and press ram 31 is guided by means of the deflecting rollers 43.

For statically separating the particle/fiber mat entry region in the rolling-rod straightening region I, precompaction stage II, postcompaction stage III and the main pressing region IV, the regions are positively and non-positively connected by three flexible hinge systems. The entry gap II can be varied by adjusting the compression angles t and s, and the rolling rod entry angle.

The gear wheels are positively connected to a resilient rolling plate 15 by means of wheel cases 44. The leaf spring assembly 45 follows with non-positive engagement over the wheel case adjusting line 46 and the cylinder stroke of the hydraulic actuators 47, a plurality of which are arranged over the width of the pressing region.

Depending on the application requirement, the most optimum angular position t above the pivot axis P of the hinge is set by the control system by means of hydraulic actuators 48, which in turn are supported with respect to the rigid press ram 31. The flexible transfer plate 49 underneath the hinge axis P is designed such that it follows the angle setting which is dependent on the angular position t. For example, it is convex in the case of a positive setting and it is concave in the case of a negative setting.

Arranged upstream of the entire entry system is a position measuring system 50, which measures the particle/fiber mat height $w_1$, by the position sensor 52 and passes the measured value to the computer 54. The measured value corresponds to a manipulated variable of the hydraulic actuators 48 and 51, a precondition being that, after running through the safety zone Z, the particle/fiber mat 28 contacts the upper steel belt 24, preferably at the upper contact-making line N of the precompaction stage II.

The continuously operating press according to the invention permits a controlled setting of the decompression $D_k'$ and of the compression K' (see FIG. 2) to take place along the pressing zones B, C and E as desired at each press frame 10, so that, irrespective of the fiber/particle board thickness, an optimum apparent density profile (e.g., the density profile shown in either FIG. 7 or FIG. 8) can be set on line at maximum production speed.

In practical applications, the starting line 19 and 20 for decompression and compression varies between two, or at most three, frame positions (see FIG. 9) according to the production speed, so that, with regard to a low-cost design of the installation, the arrangement of only one to three snap-action hinges 21 are arranged in the exit region of the high-pressure zone B which exerts about 4–5N/mm$^2$ pressing pressure at the transition and, in the low-pressure zone C, pressing pressure of only about 0–1N/mm$^2$ is exerted. For the same reason, only one to three snap-action hinges 21 need to be arranged in the transition region from the low-pressure zone C to the calibrating zone E of higher pressure of about 1.5–2.5N/mm$^2$. Without restricting the process, the specific assignment (FIG. 9) of the snap-action hinges 21 provides the advantage of a low-cost configuration.

In one preferred embodiment, each of the press platen segments 9 has a curved pressing face **9*a* and a straight pressing face 9*b*, the straight pressing face 9*b* being provided on a side of the press platen segment 9** which is closer to an entrance region of the press for the pressing stock.

In order to realize as great a heat transfer area as possible, it is furthermore advantageous for the supporting radius R (see FIG. 5) of the press platen segments 9 to be provided in the $D_k'$ region only at one side of the transporting direction and to be provided in the K' region only at the side which is counter to the transporting direction.

A major process advantage of the invention lies in the steep decompression and compression angle, where tan β is approximately 0.05, together with a useable vertical jump controllable from 0 mm to approximately 10 mm.

Figure 5:
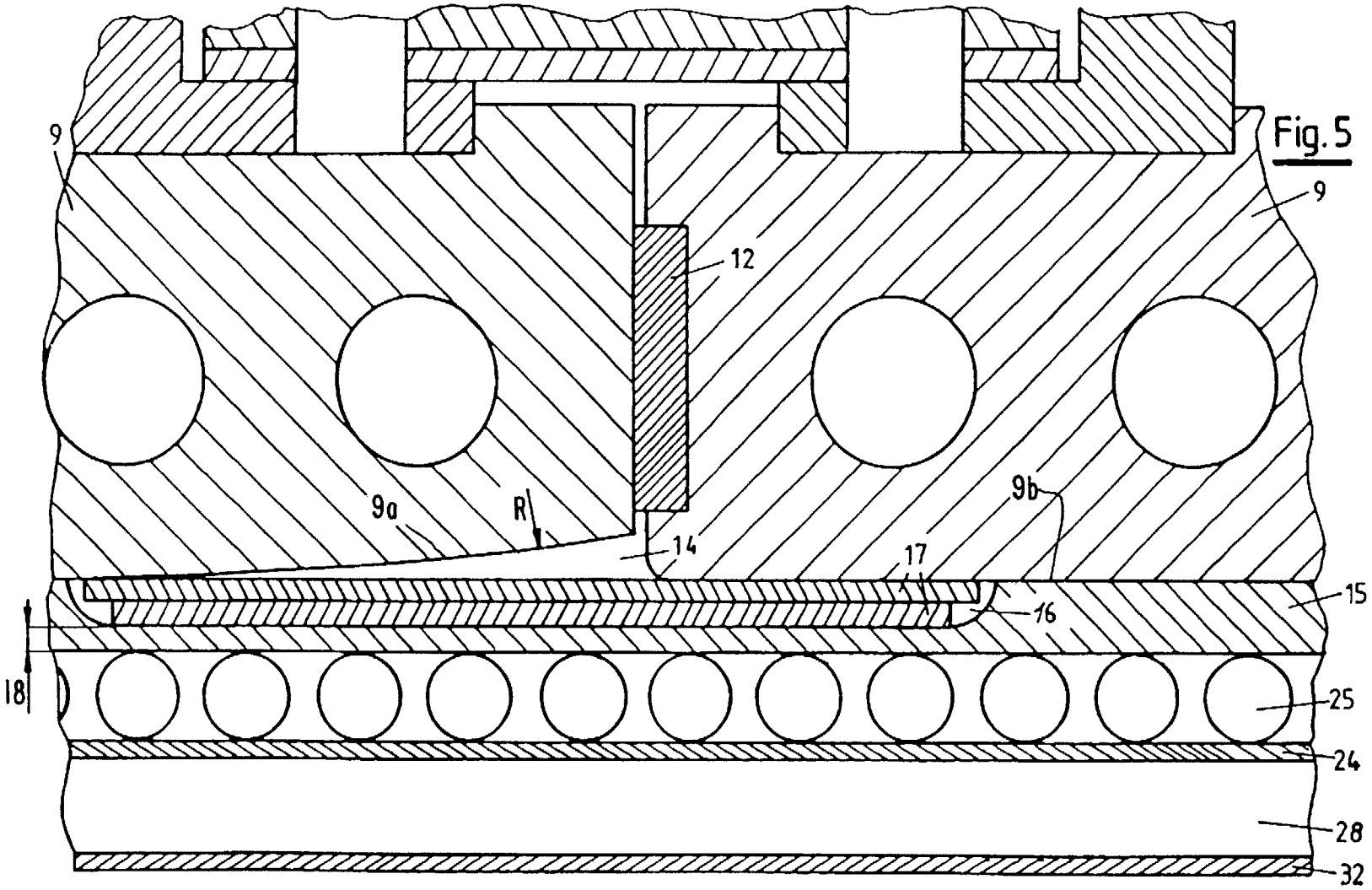
Figure 6:
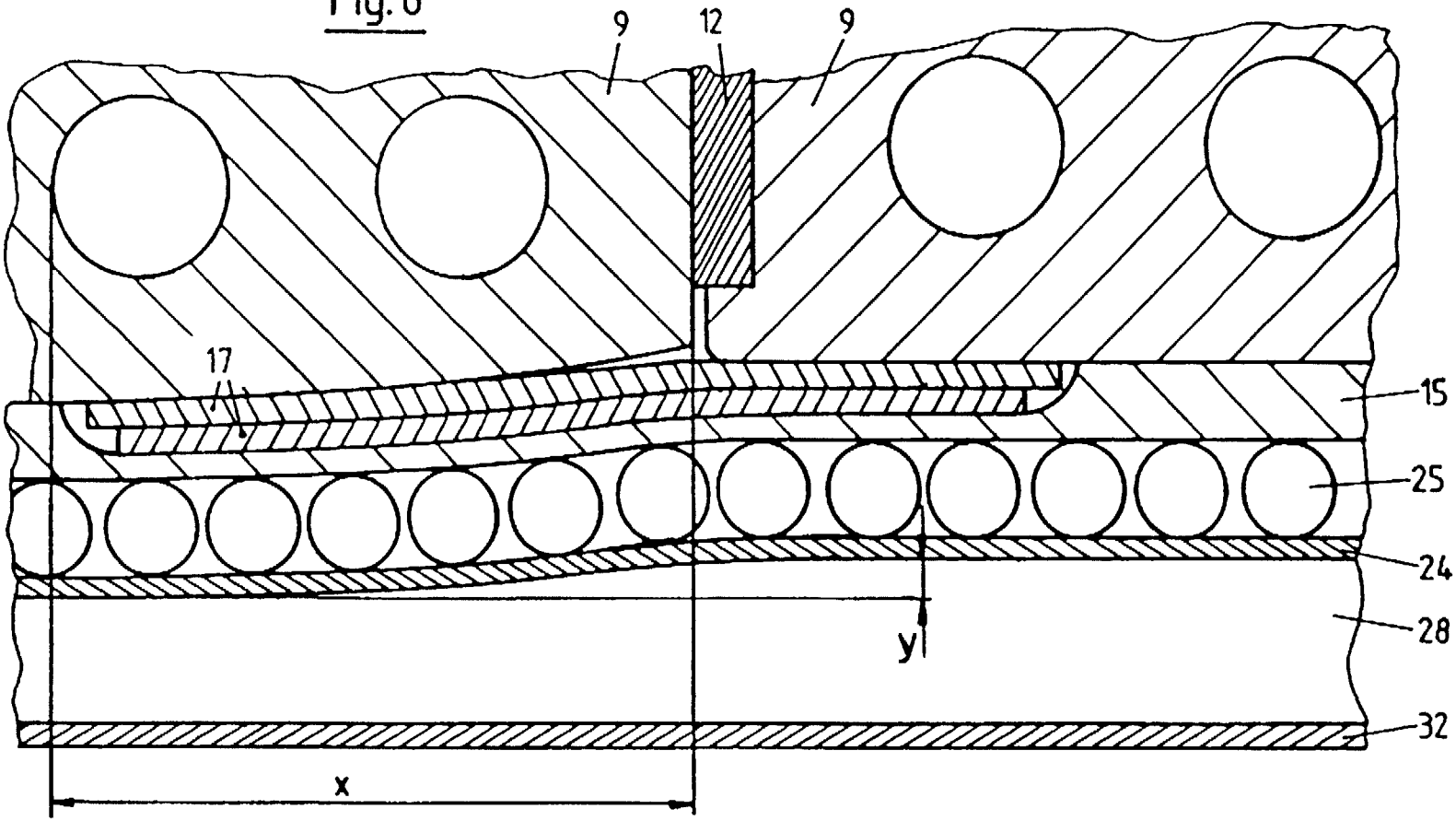

The relative vertical displacement of the pressing platen segments 9 advantageously achieves the effect of a fast decompression and compression through the steep angle β in contrast with the shallow angle α of known hinge systems according to DE 43 01 594. Referring to FIGS.5 and 6 steep β(tan β=0.05) results from the usable vertical jump y =10 mm between the pressing platen segments 9 and the length of arc section x=200 mm, which results from a supporting radius R of approximately 1575 mm.

Figure 4:
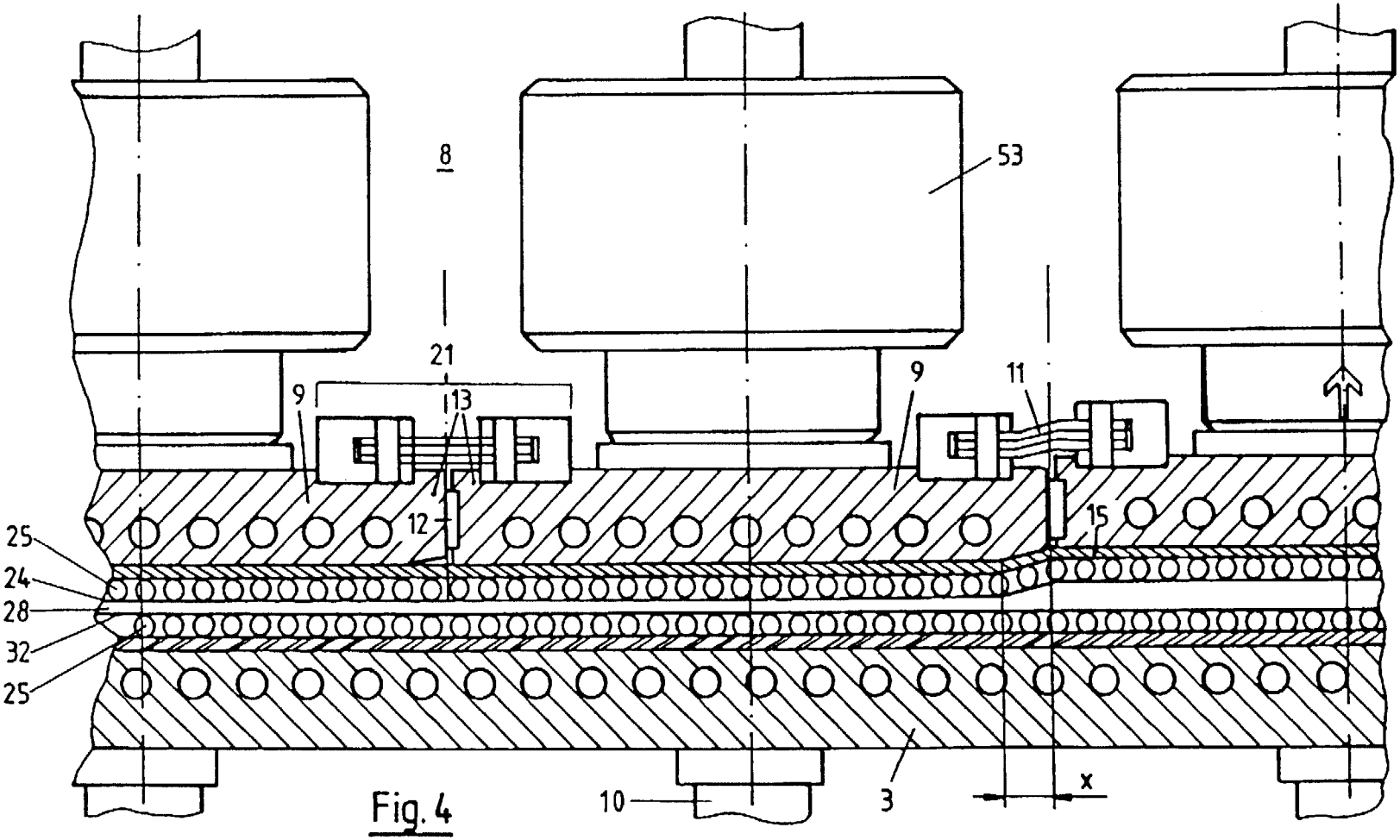
FIGS. 4–6 show the snap-action hinge system according to the invention, equipped with a resilient coupling, for setting a steep angle $\beta$ and $\beta_1$in the load-relieving zone c.

In contrast to the configuration according to EP 0 380 527, the steel belt 24 is supported by means of the rolling rods 25 in an advantageous way against the rolling plate 15 by the spring assembly 17 in groove 16, which resiliently bears in close contact against the supporting radius R (see FIGS. 4–6). The supporting radius R is preferably approximately 315 times the thickness of the spring assembly plates 17 or rolling plate 15, which in the exemplary embodiment is defined as 5 mm. As a result, the flexurally elastic functional components 15, and 17 according to the invention remain in the permissibly tolerable strength range. By virtue of the positively engaging close contact with the rolling plate 15, it is possible even at high steel belt speeds of approximately 600 mm/s and at relatively high specific pressing pressures of 2.5N/mm$^2$ (sustained in the compression region k') to bridge strain paths with tan β=10:200 in a gentle arc radius with a variable setting capability. Consequently, the dynamically loaded functional components 15, 24 and 25 are conserved with a view to a long service life and for this reason, the rolling plate 15 is hardened to 400 to 550 Brinell. In contrast, according to the prior art, the variable setting is tan α=about 2:1000 (FIG. 1) along the pressing length b, c, and e.

Figure 8:
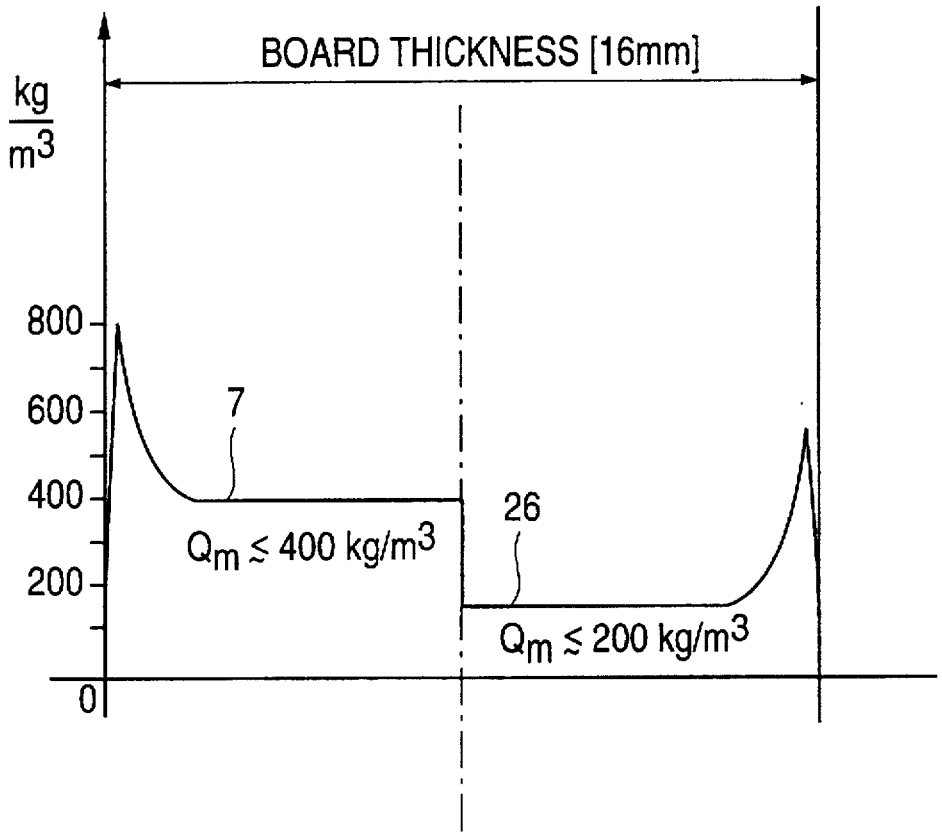
FIG. 8 shows the density profile for a 16 mm thick board produced by the continuously operating press according to the invention.

In terms of process engineering, ultra lightweight boards with an apparent density of less than or equal to 400 kg/m$^3$ (e.g., fiber mats of pine wood or of the superlightweight balsa wood 26 of FIG. 8) can be produced only with a steep load-relieving jump tan β of approximately 0.05 in the decompression region $D_k'$ and such a steep load-relieving jump is possible with the continuously operating press according to this invention.

Figure 7:
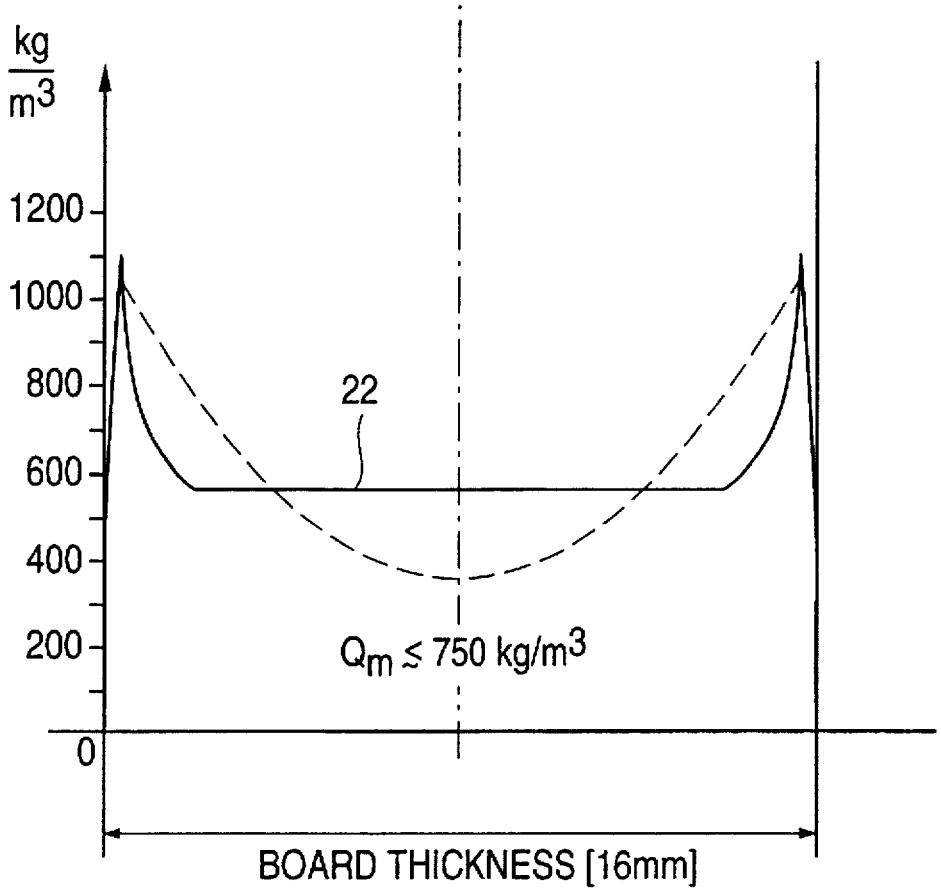
FIG. 7 (PRIOR ART)
FIG. 7 shows the density profile for a 16 mm thick board produced by the prior art continuously operating press.

In the case of fiber (MDF) boards, with regard to an optimum apparent density profile as shown in FIG. 7 or 8, in order to obtain a homogeneous density structure in the core of the finished pressed board, it is necessary, after the high compaction of the face layers in the high-pressure zone B and once the main amount of heat has been introduced in the high-pressure region, for the particle fiber mat 28 to be relieved quickly to a greatly reduced pressing pressure, in most cases to virtually zero N/mm$^2$. For this reason, the press nip 1 is greatly enlarged in the low-pressure zone C. Depending on the density and thickness of the particle fiber mat 28, the expansion in the press nip 1 is approximately 30% to 70% of the desired board thickness 4. If a relieving of the fiber mat in the $D_k'$ region takes place too slowly, an inhomogeneous density structure occurs, analogous to the profile curve 22 (FIG. 7).

If, for example, in a way corresponding to currently established practice and in the case of a desired thickness of 20 mm and 50% strain relief in the nip region 1, a nip clearance of 30 mm is set, the prior art of FIG. 1 requires that, given a maximum possible degree of deformation of 2 mm per 1000 mm, a decompression zone $d_k$ of approximately 5 m of press length is necessary. At the end of the low-pressure zone C, the particle fiber mat 28 is pervaded well with heat to the core at 90° C. to 100° C., so that the incipient gelling process, i.e., the curing in the core of the particle fiber mat 28, begins. At this point in time, the particle fiber mat 28 is compacted again to the desired thickness of the finished board to form a board which is finished, cured and in a planarly calibrated state in the zone e. In the compression stage (zone k) of this example, a press length of approximately 5 m is required.

When using the snap-action hinge system according to the invention, only a press length $D_k'$ and K' of 0.4 m is required for the same process-engineering task. With a customary press length of about 30 m, a press length of 32% can be saved. Viewed in another way, since more pressing length is available, it is possible to run at production rates which are higher by 25% to 35% by means of a higher steel belt speed. This is also illustrated by the greater heat energy potential which is supplied to the pressing stock on account of the longer pressing force action available (see FIG. 3).

While particular embodiments according to the invention have been illustrated and described above, it will be clear that the invention can take a variety of forms and embodiments within the scope of the appended claims.

We claim:

1. A continuously operating press for producing boards from pressing stock, comprising:

a heating platen provided on a first side of the press;

a plurality of press platen segments arranged on a second side of the press opposite to the heating platen, adjacent ones of the press platen segments being resiliently coupled to one another, a separation space between respective press platen segments and the heating platen defining a plurality of press nips; and hydraulic pressing-force cylinders respectively coupled to the press platen segments for displacing individual ones of the press platen segments relative to the heating platen independently of other press platen segments.

2. A continuously operating press as recited in claim 1, wherein each press platen segment is resiliently coupled to a neighboring one of the press platen segments.

3. A continuously operating press as recited in claim 1, further comprising:

a pair of driving wheels;

a pair of reversing wheels; and a pair of flexible, endless belts driven by the driving wheels around the reversing wheels and between the heating platen and the press platen segments, the belts drawing in the pressing stock therebetween.

4. A continuously operating press as recited in claim 3, further comprising a friction reducing surface disposed between a first one of the belts and the heating platen, or between a second one of the belts and the press platen segments.

5. A continuously operating press as recited in claim 4, wherein, either between the first belt and the heating platen or between the second belt and the press platen segments, the friction reducing surface includes flexurally elastic rolling plates arranged adjacent to the respective one of the heating platen and the press platen segments, and a carpet of rolling rods which are connected to one another by plate-link chains and which support one of the belts against the rolling plates.

6. A continuously operating press as recited in claim 1, further comprising a hydraulic control system including a computer, the system controlling a vertical motion of at least one or more of the hydraulic pressing-force cylinders.

7. A continuously operating press for producing boards from pressing stock, comprising:

a heating platen provided on a first side of the press;

a plurality of press platen segments arranged on a second side of the press opposite to the heating platen, adjacent ones of the press platen segments being resiliently coupled to one another, the press platen segments having a curved pressing face and a straight pressing face, the straight pressing face being provided on a first side of the press platen segments which is closer to an entrance region of the press for the pressing stock, a separation space between respective press platen segments and the heating platen defining a plurality of press nips; and hydraulic pressing-force cylinders respectively coupled to the press platen segments for independently adjusting the press nips for the press platen segments.

8. A continuously operating press as recited in claim 7, further comprising:

a rolling plate disposed between the heating platen and the press platen segments.

9. A continuously operating press as recited in claim 8, wherein the rolling plate includes a groove for receiving spring plates extending from and flexurally connecting one of the press platen segments to a neighboring one of the press platen segments.

10. A continuously operating press as recited in claim 9, wherein the rolling plate has a thickness which varies from 4 mm to 16 mm.

11. A continuously operating press as recited in claim 10, wherein the curved pressing face has a radius of curvature of R which is approximately 315 times the thickness of the rolling plates.

12. A continuously operating press as recited in claims 11, wherein the rolling plate hardened throughout and has a surface-hardness from 400–550 Brinell.

13. A continuously operating press as recited in claim 10, wherein the curved pressing face has a radius of curvature of R which is approximately 315 times the thickness of the spring plates.

14. A continuously operating press for producing boards from pressing stock, comprising:

a heating platen provided on a first side of the press;

a plurality of press platen segments arranged on a second side of the press opposite to the heating platen, adjacent ones of the press platen segments being resiliently coupled to one another, a separation space between respective press platen segments and the heating platen defining a plurality of press nips;

a snap-action hinge resiliently coupling one of the press platen segments to a neighboring one of the press platen segments; and hydraulic pressing-force cylinders respectively coupled to the press platen segments for independently adjusting the press nips for the press platen segments.

15. A continuously operating press as recited in claim 14, further comprising a decompression zone including a first set of press platen segments and a compression zone including a second set of the press platens segments spaced from the first set, wherein one to three snap-action hinges are arranged near an entrance region of the decompression zone and one to three snap-action hinges are arranged near an entrance region of the compression zone.

* * * * *